US006925191B2

(12) United States Patent
Petroff et al.

(10) Patent No.: US 6,925,191 B2
(45) Date of Patent: Aug. 2, 2005

(54) FLAT PANEL SPEAKER

(75) Inventors: Michael Petroff, Northridge, CA (US); Mayuki Yanagawa, North Hollywood, CA (US); Keiko Muto, North Hollywood, CA (US)

(73) Assignee: Digital Sonics LLC, Los Angeles, CA (US)

( * ) Notice: Subject to any disclaimer, the term of this patent is extended or adjusted under 35 U.S.C. 154(b) by 388 days.

(21) Appl. No.: 10/056,860

(22) Filed: Jan. 23, 2002

(65) Prior Publication Data

US 2002/0176597 A1 Nov. 28, 2002

(Under 37 CFR 1.47)

Related U.S. Application Data

(63) Continuation-in-part of application No. PCT/US00/40475, filed on Jul. 24, 2000

(60) Provisional application No. 60/145,368, filed on Jul. 23, 1999.

(51) Int. Cl.[7] ..... H04R 25/00

(52) U.S. Cl. ..... 381/423; 381/186; 381/386; 381/424; 381/431

(58) Field of Search ..... 381/423, 424, 381/425, 429, 430, 431, 432, 182, 184, 186, 151, 386, 396, 345, 350, 351, 353, 354; 181/144, 163, 164, 171, 172, 173

(56) References Cited

U.S. PATENT DOCUMENTS

| | | | | |
|---|---|---|---|---|
| 3,569,638 A | | 3/1971 | Schoengold | |
| 3,718,779 A | | 2/1973 | Schoengold | |
| 4,232,204 A | * | 11/1980 | Rojas | 381/186 |
| 4,477,699 A | * | 10/1984 | Wada et al. | 381/184 |
| 4,517,416 A | * | 5/1985 | Goossens | 381/431 |
| 4,567,327 A | | 1/1986 | Goossens et al. | |
| 4,997,058 A | | 3/1991 | Bertagni | |
| 5,007,707 A | | 4/1991 | Bertagni | |
| 5,218,575 A | | 6/1993 | Cherek | |
| 5,425,107 A | | 6/1995 | Bertagni et al. | |
| 5,539,835 A | | 7/1996 | Bertagni et al. | |
| 5,586,195 A | * | 12/1996 | Ishigaki et al. | 381/386 |
| 5,615,275 A | | 3/1997 | Bertagni | |
| 5,693,917 A | | 12/1997 | Bertagni et al. | |
| 5,701,359 A | | 12/1997 | Guenther et al. | |
| 6,031,926 A | | 2/2000 | Azima et al. | |
| 6,144,746 A | | 11/2000 | Azima et al. | |
| 6,199,655 B1 | | 3/2001 | Norris | |
| 6,243,478 B1 | | 6/2001 | Tsao | |
| 6,278,787 B1 | | 8/2001 | Azima | |

FOREIGN PATENT DOCUMENTS

| | | |
|---|---|---|
| JP | 60043998 | 3/1985 |
| JP | 62296700 | 12/1987 |
| WO | WO97/09842 | 3/1997 |
| WO | WO97/09843 | 3/1997 |
| WO | WO97/09858 | 3/1997 |
| WO | WO98/31188 | 7/1998 |
| WO | WO00/22877 | 4/2000 |

* cited by examiner

*Primary Examiner*—Huyen Le
(74) *Attorney, Agent, or Firm*—Liu & Liu

(57) ABSTRACT

A loudspeaker having a back plate, a driver attached to the back plate, the driver being responsive to an electrical signal, an enhancer having a neck and a mouth, the neck attached to the driver and movable in accordance with the movement of the driver, a thin film membrane, the membrane attached to the enhancer, the membrane stretched over the frame, a frame for supporting the membrane and maintaining it in a taut state, and a rubber type adhesive for dampening the membrane resonances and for adhering the membrane to the frame. Clarity of sound can be further improved by including a plurality of sound breathers in the back plate of the speaker. For improved sound radiation capability, the size and the shape of the enhancer can be modified in various ways, including a frustoconical, parabolic, or bell-shaped enhancer.

27 Claims, 9 Drawing Sheets

Fig. 5
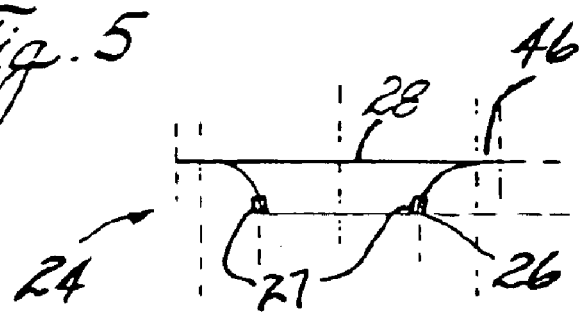
Fig. 6
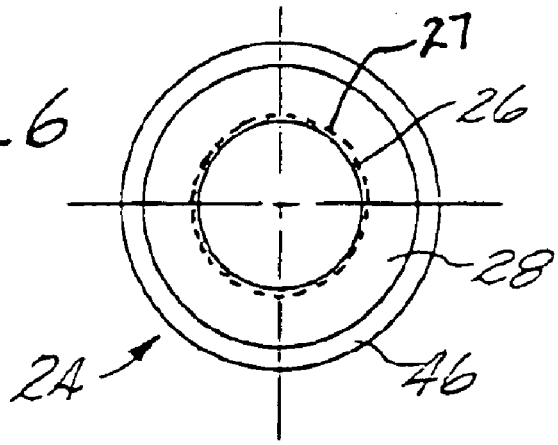
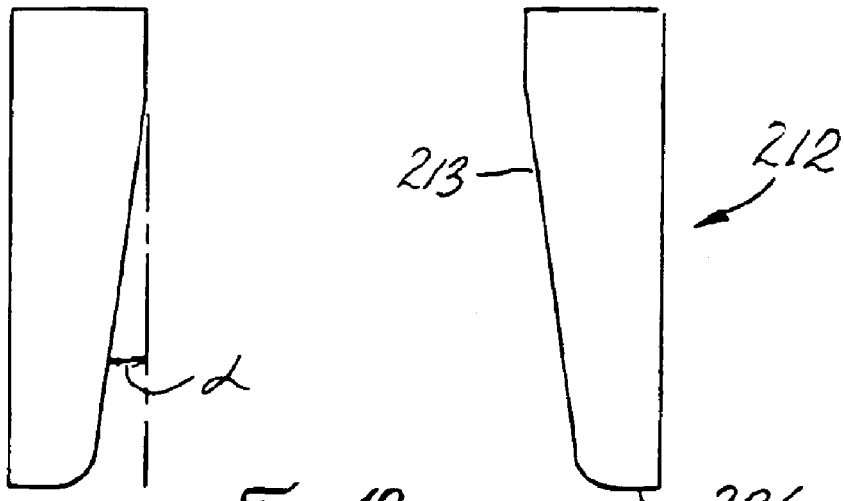
Fig. 18

FLAT PANEL SPEAKER

This is a Continuation-in-Part of International Application PCT/US00/40475, with an international filing date of Jul. 24, 2000, which claims the priority of U.S. Provisional Application No. 60/145,368 filed Jul. 23, 1999.

BACKGROUND OF THE INVENTION

1. Field of the Invention

This invention relates to loudspeakers and more particularly to loudspeakers having a flat panel design.

2. Description of the Related Art

Dynamic loudspeakers typically include a relatively stiff diaphragm that is coupled to an electromagnetic driver assembly, which basically comprises a voice coil and a permanent magnet. Such loudspeakers are usually mounted so as to occupy an opening in an enclosure or baffle. The interaction of the magnetic field of the permanent magnet and the varying magnetic field of the voice coil that is produced when a changing current is passed through the voice coil causes the loudspeaker diaphragm to vibrate. Vibration of the diaphragm causes movement of air, which in turn produces sound.

The advantages of the moving-coil drive unit are that its operation and design are widely understood and used, the components parts are readily available and it is inexpensive to produce. One disadvantage is that this drive unit is very inefficient as a transducer, typically converting between 1 and 3% of the electrical energy into sound energy. Another disadvantage of moving-coil drive units is that the mechanical inertia resulting from the mass of the driver itself makes it impossible for the driving part to start and stop instantly. This sets a limit on the transducer's bandwidth and on its ability to reproduce transients clearly.

To overcome the disadvantages of the typical moving-coil drive units, there has been developments in the areas of "mass-less" drivers. One such driver is the piezoelectric type. A piezoelectric speaker utilizes crystalline materials that will twist or bend mechanically when a voltage is applied. The resulting movement is very small and in practice crystal transducers are generally matched to a horn to improve efficiency. The problem with the piezoelectric transducer is that it has a limited bandwidth and its application is therefore limited to reasonably flat frequency response and low coloration.

Another attempt at the "mass-less" drive unit has been the flat panel loudspeaker, which uses low mass sheets or film in place of a cone diaphragm. The operating principle of the traditional electrostatic flat speaker is that of a two plate capacitor. One plate is a fixed electrode, the other is a stretched conductive plastic film. Both the audio signal and a DC polarizing voltage are applied across the plates. The applied voltage is varied in accordance with the audio signal. The charge between the plates also varies. The size of the electrostatic charge determines the attractive force and thus the film diaphragm is set in motion.

The loudness of the sound produced by a loudspeaker is related to the volume of air moved in from the loudspeaker by vibration of the diaphragm. Generally, the greater the volume of air moved by the diaphragm as it vibrates, the greater the loudness. The loudness of sound produced relative to the electrical energy provided as an electric current through the voice coil is also used to measure the efficiency of the loudspeaker.

It is desirous to make speakers more compact and flat for easy installation in locations with restricted areas such as walls, panels and other flat surface areas. The disadvantage of the electrostatic flat speaker is that manufacturing is difficult. This speaker requires a DC voltage source and a step-up transformer for impedance matching, which creates additional expense. Also, the speaker would have to be large to create good bass.

Even the smallest conventional speakers that use relatively rigid paper or plastic cones, or diaphragms, require an air enclosure having a thickness dimension typically well in excess of three inches. This is ordinarily required to provide acceptable sound reproduction in the low/mid frequency regions where voices and musical instruments produce most of their sound energy. The air enclosures, however, inherently "resonate" in such a manner as to accentuate some frequencies while diminishing others, thereby significantly detracting from the naturalness and clarity of the reproduced sound. It is desirable to have a speaker without the air enclosure, thus without the altered and unnatural acoustic effect, and with improved sound quality and a reduction in speaker thickness.

Additionally, high quality conventional cone speakers inherently require multiple speaker elements, known as woofers, midranges, and tweeters, each specializing in the reproduction of a different frequency range of sound. The difficulty with such multi-element designs is that the transitions between the speaker elements cannot be smoothly blended at all listening angles, which again results in reduced naturalness and clarity of the reproduced sound.

A known flat panel loudspeaker has been developed which uses a very stiff panel whose characteristics must conform to a specific mathematical relationship. This panel can be excited by a transducer such as a moving-coil element or a piezoelectric crystal. If all the parameters are met, the panel has a complex bending behavior resulting in a large number of seemingly randomized vibrational modes distributed across the panel surface. The disadvantage of this device is that the complex bending behavior of the panel requires precise manufacturing, which is costly and time consuming.

It is, therefore, desirable to have a compact, flat speaker with a non-rigid planar diaphragm that emits high quality sound over a wide bandwidth while maintaining low manufacturing costs.

SUMMARY OF THE INVENTION

A compact, flat speaker of the present invention emits high quality sound over a wide bandwidth. Further, the manufacturing costs for the speaker are minimized by providing a speaker that is easy and inexpensive to manufacture. In addition, the speaker configuration substantially reduces the likelihood of membrane tearing or having a distorted membrane surface.

The loudspeaker of the present invention has a driver attached to a back plate and a sound enhancer. The driver is responsive to an electrical signal. A frame attached to the back plate supports a thin film membrane, which is stretched and attached to the frame. The membrane is attached to the frame, for example, by adhesion using a rubber type adhesive that dampens the membrane resonance. Preferably, the membrane does not have a hole; an alternate embodiment shows the membrane with a hole. The enhancer has a neck attached to the driver and a mouth attached to the membrane. The enhancer is movable in accordance with the movement of the driver. An embodiment shows a driver provided with a round yoke, which rests on a frame that is perforated. An alternate embodiment shows a clamp ring that clamps the membrane to the frame while keeping the membrane under tension.

Clarity of sound can be further improved by including a plurality of sound breathers in the back plate of the speaker. For improved sound radiation capability, especially in the middle and high frequency sound ranges, the size and the shape of the enhancer can be modified in various ways, including a frustoconical, parabolic, or bell-shaped enhancer.

BRIEF DESCRIPTION OF THE DRAWINGS

FIG. 2 is a side view of a bell-shaped enhancer utilized in an embodiment of the present invention.

FIG. 3 is a side view of a frustoconical enhancer utilized in an embodiment of the present invention.

FIG. 4 is a side view of a parabolic enhancer utilized in an embodiment of the present invention.

FIG. 5 is a side view of an enhancer utilized in an embodiment of the present invention.

FIG. 6 is a plan view of the enhancer of FIG. 5.

FIG. 18 is a cross-sectional view of the clamp ring through section 18—18 of FIG. 17.

DETAILED DESCRIPTION OF THE PREFERRED EMBODIMENT

The present description is of the best presently contemplated mode of carrying out the invention. This description is made for the purpose of illustrating the general principles of the invention and should not be taken in a limiting sense. The scope of the invention is best determined by reference to the appended claims.

Figure 1:
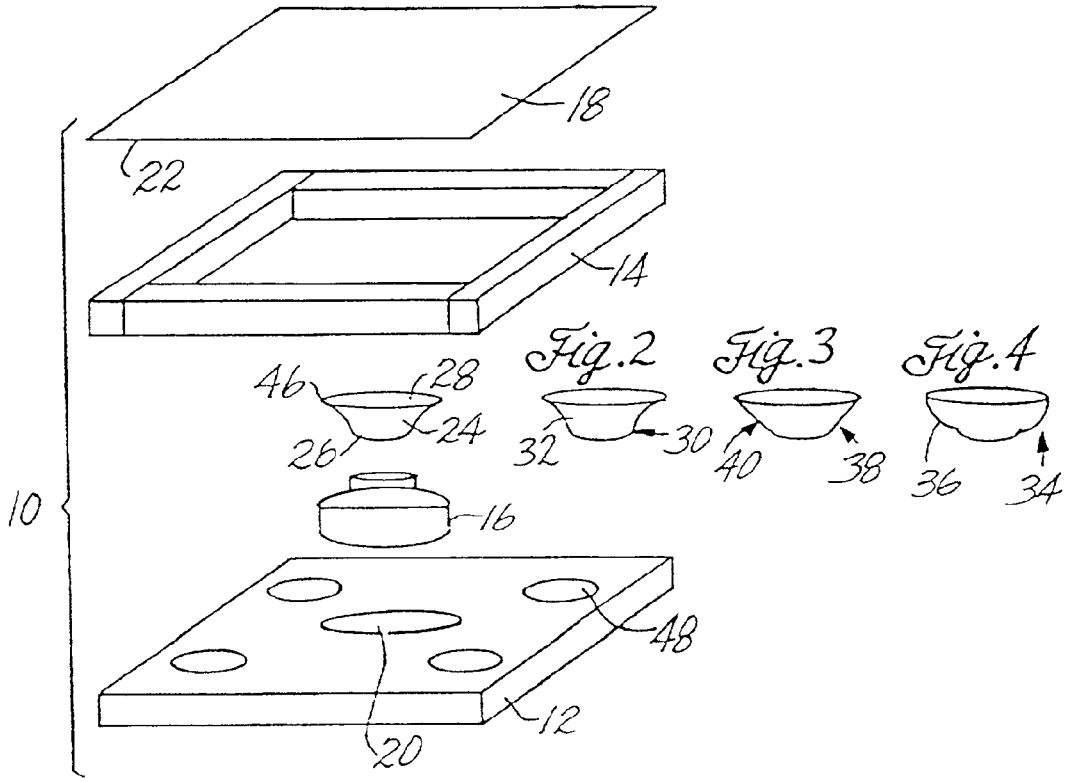
FIG. 1 is an expanded view of the flat panel speaker according to a preferred embodiment of the present invention.

FIG. 1 illustrates an expanded view of a first embodiment of a flat panel loudspeaker 10. The flat panel loudspeaker 10 has a back plate 12 with a driver 16, an open frame member 14 coupled with the back plate, a sound enhancer 24 coupled with the driver 16, and a membrane (or diaphragm) 18 attached to the sound enhancer and stretched across the frame member 14. The driver 16 vibrates in response to an electrical signal, which in turn vibrates the sound enhancer 24 and membrane 18, thereby producing sound.

The back plate 12 and frame member 14 provide structural support for the speaker 10 and can be made of any rigid material that will maintain the structural integrity of the speaker while in use. The materials for the back plate and frame member may include a hard plastic, a metal (i.e., Aluminum), and/or wood.

In one embodiment, the thickness of the back plate 12 together with the attached and/or integral frame member 14 is equal to the sum of the thicknesses of the driver 16 and the enhancer 24. In a preferred embodiment, the thickness of the speaker, including the frame member and the back plate, is less than about 50 mm, and in one embodiment, less than about 30 mm, and in a more specific embodiment, less than about 18.5 mm.

In one embodiment, the open frame member 14 has the same outer shape and size as the back plate 12, as shown in FIG. 1. The back plate has a substantially solid flat rectangular shape. The frame member has a rectangular shape that is solid around the edges and open in the center. The outer edges of the frame member fits onto and aligns with the outer edges of the back plate when the frame member and back plate are coupled. In another embodiment, the frame member and the back plate have an area of about 25 square inches, with lengths and widths of about 5 inches each.

The frame member is not limited to an open rectangular shape, however. For example, in another embodiment, the edges of the open frame member are rounded as discussed in more detail below. In another embodiment, the frame member is the same size and shape or smaller than the back plate. In another embodiment the frame member is integral with the back plate regardless of the respective shapes.

The back plate 12 has a recess 20 provided for the driver 16. In one embodiment, the recess 20 in the back plate is centrally located with respect to the attached frame member. The driver is placed inside the recess 20 such that the bottom of the driver is aligned with and preferably attached to the bottom of the back plate 12. By placing the driver in the back plate, the thickness of the speaker 10 is thereby minimized. The driver 16 is discussed in more detail below.

Figure 8:
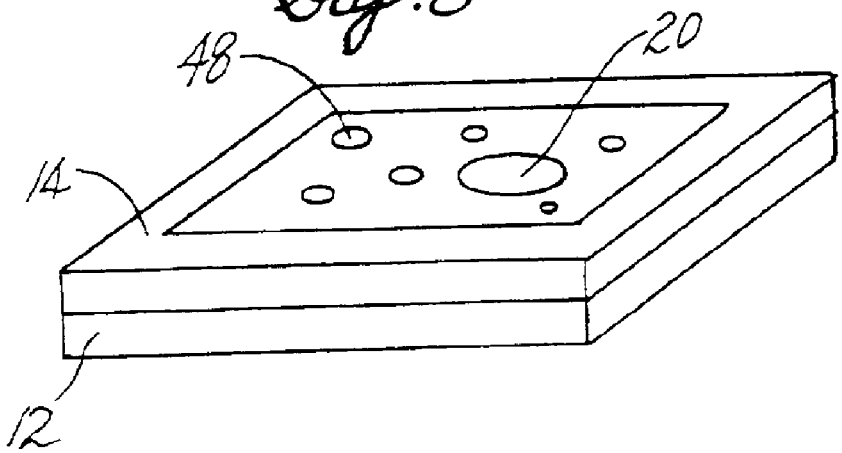
FIG. 8 is a plan view of an alternative embodiment of the frame member and the back plate with an off-center recess for a driver.

In an alternative embodiment shown in FIG. 8, the recess 20 in the back plate 12 for the driver is off-centered with respect to the frame member 14. The off-centered recess 20 with respect to the frame member 14 (and subsequently the off-centered position of the driver with respect to the membrane) could provide improved sound quality by minimizing undesirable resonances.

Figure 7:
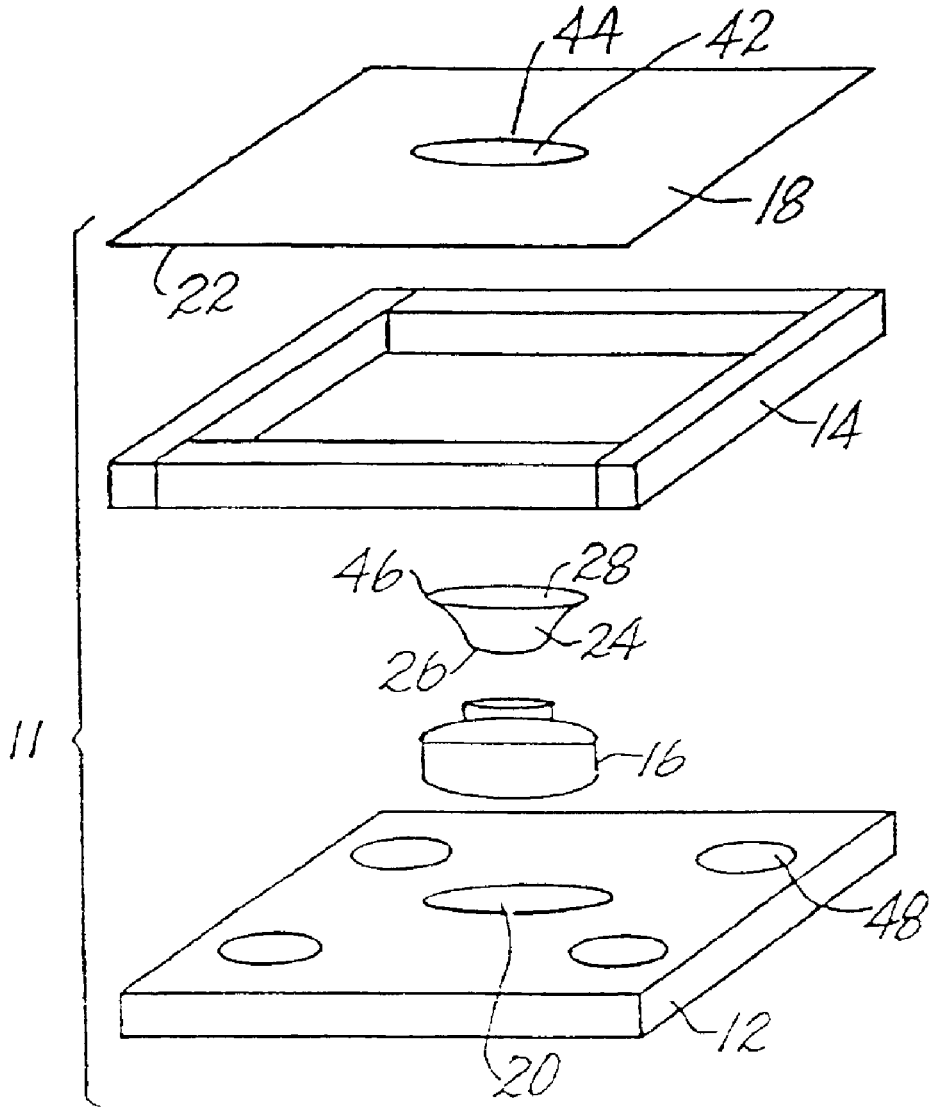
FIG. 7 is an expanded view of the flat panel speaker according to another embodiment of the present invention.

An alternate embodiment shows a flat panel loudspeaker 11 with a hole 42 provided in the membrane 18, as shown in FIG. 7. The hole 42 is defined by an inner substantially circular edge 44 of the membrane 18. The hole 42 could improve the medium and high frequency sound emissions of the membrane 18 by clearing the path of the movement of air. The hole 42 is preferably about the same size as the mouth 28 of the enhancer 24. The inner edge 44 defining the hole 42 is attached by means of using a double adhesive tape (3M) and acrylic adhesive to the rim 46 of the enhancer 24 that surrounds the mouth 28 as described below.

Sound Breathers

For further improvement of sound clarity, a plurality of openings or sound breathers 48 is disposed in the back plate 12 (see also FIG. 1). The sound breathers 48 are provided in the back plate 12 to release the air that is trapped between the back plate 12 and the membrane 18. Without the sound breathers 48, the air trapped between the back plate and the membrane has an undesirable dampening effect on the vibratory motion of the membrane 18. The use of sound breathers 48 increases acoustic resistance and provides heat transfer from the electromagnetic driver. The number and size of the sound breathers are design choices that affect the sound quality. Generally, the more sound breathers, the better the sound quality. However, the number of sound breathers is limited so as to not compromise the structural integrity of the back plate 12. The size, number and location of the sound breathers 48 shown in the Figures are for illustrative purposes only.

Frequency Response

The frequency response characteristics of the loudspeaker can be changed by altering the shape, thickness or material of the sound enhancer 24. FIG. 1 depicts an enhancer 24 having a neck 26, a mouth 28, and a surface that increases in circumference between the neck 26 and the mouth 28, flaring out at the mouth. The sound enhancer 24 improves the sound radiation capability of the speaker.

Depending on the desired frequency response of the loudspeaker, the enhancer can be modified to have any shape. FIG. 2 depicts a bell-shaped enhancer 30 with an outer surface 32 that flares out at the mouth, similar to the enhancer shown in FIG. 1. FIG. 3 depicts another alternative enhancer 38 having a frustoconical shape. Enhancer 38 has a neck, a mouth, and a surface 40 that forms a straight surface between the neck and the mouth. FIG. 4 depicts an alternative parabolic enhancer 34 having a neck, a mouth and a surface 36 that forms a convex parabolic shape between the neck and the mouth. The enhancers in FIGS. 2–4 can be used in the alternate embodiment shown in FIG. 7 as well as in the embodiment in FIG. 1.

Enhancer

FIGS. 5 and 6 depict an embodiment for the enhancer 24. The enhancer has a neck 26, a mouth 28, and a surface that increases in circumference between the neck 26 and the mouth 28, flaring out at the mouth. Along the edge of the mouth is a rim 46. The rim 46 of the enhancer is substantially flat and extends out horizontally from the mouth. In an embodiment, the aspect ratio of diameter of the mouth to thickness of the enhancer measured from the neck to the mouth ranges from about 3:1 to 20:1, and preferably the aspect ratio of diameter of the mouth to thickness of the enhancer measured from the neck to the mouth ranges from about 8:1 to 13:1, and the ratio of diameter of the neck to diameter of the mouth of the enhancer ranges from about 3:5 to 3:4.

The circular rim 46 extends out in a flat manner 1 to 2 mm from the edge of the mouth. The diameter of the enhancer at the neck ranges from about 15 mm to 30 mm, but preferably is about 25 mm. The diameter of the enhancer at the mouth ranges from about 25 mm to 40 mm, but preferably is about 33 mm. The vertical distance from the neck to the mouth ranges from about 2 mm to 8 mm, but preferably is about 3 mm. The neck 26 is attached to the driver 16, while the rim 46 is attached to the membrane 18 as discussed below, such that the vibrations from the driver 16 are transmitted through the enhancer 24 to the membrane 18. These shapes are shown only as examples and can be used with the speakers disclosed in any of the embodiments of the present invention.

The enhancer is preferably made from a fiber-reinforced paper composite. For example, the enhancer is a composite made from paper and fibers, such as fiberglass. In another embodiment, the enhancer is made from paper and an aramid fiber, such as Kevlar® by duPont. The composite is made of about 20–30% by weight Kevlar fibers. Altering the amount of fibers that are used in the composite alters the frequency response of the speaker, in particular, the frequency response in the high frequency range.

In another embodiment, oil with magnetic particles in colloidal suspension is placed inside the enhancer at a location near the neck to dampen the diaphragm resonaces. The magnetic oil used is a colloidal suspension of nanoscopic magnetic particles, such as Ferrofluid® which is manufactured by Ferrofluidics Corporation of Nashua, N.H. The amount of oil placed in the enhancer has a thickness of a range of about ¼ mm to 1 mm ribbon 27 (schematically shown in FIGS. 5 and 6) around the inside and outside surfaces of the neck 26 of the enhancer 24, but preferably about ½ mm ribbon. The magnetic oil has a viscosity in the range of viscosities generally used for woofers. When the viscosity is altered, the frequency response of the speaker is affected.

Driver

Figure 9:
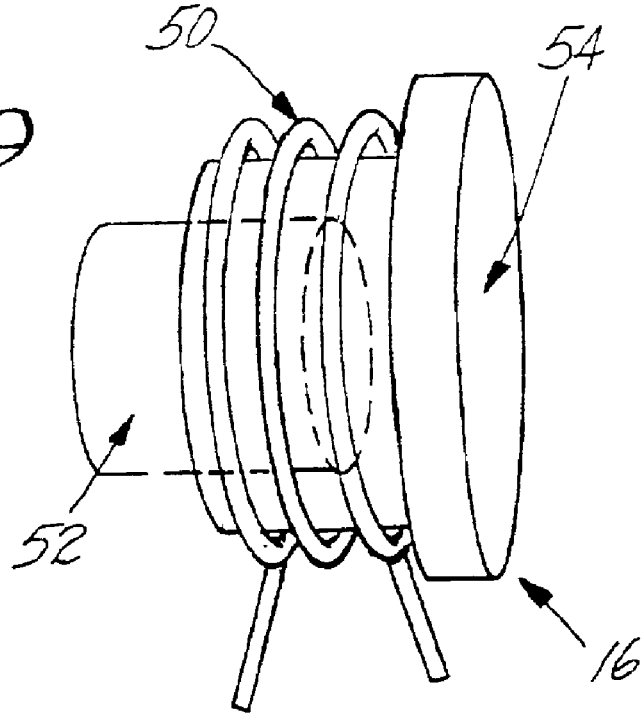
FIG. 9 is a side view of a driver utilized in an embodiment of the present invention.

The driver 16 for each of the described embodiments can be an electromagnetic driver assembly that is well known in the art. As shown in a detailed view of the driver in FIG. 9, and in the cross-sectional view of FIG. 15, the driver has a voice coil 50 wrapped about a pole piece, a permanent magnet 52 partially disposed within one end of the pole piece, a thin plate 54 attached to the other end of the pole piece, and a spider 51 that may be used to center the voice coil with respect to the pole piece without appreciably hindering the axial (in-and-out) motion of the voice coil.

In order to vibrate the driver, a changing current is passed through the voice coil 50. The interaction of the magnetic field of the permanent magnet 52 and the magnetic field of the voice coil 50 that is produced from the changing current causes the coil and consequently, the attached thin plate to vibrate with respect to the permanent magnet. The driver 16 acts as a piston to vibrate in a substantially vertical direction. The thin plate 54 is attached to the enhancer 24 at the neck 26 thereof. Because the rim 46 of the enhancer is attached to the membrane 18, as the thin plate vibrates, the enhancer and the membrane consequently vibrate, thereby producing sound. The driver could be any known electromagnetic driver assembly, including a piezoelectric assembly (not shown). In the piezoelectric assembly, the crystalline material will twist or bend in response to an applied voltage, causing the membrane 18 to vibrate and thus producing sound.

Figure 10:
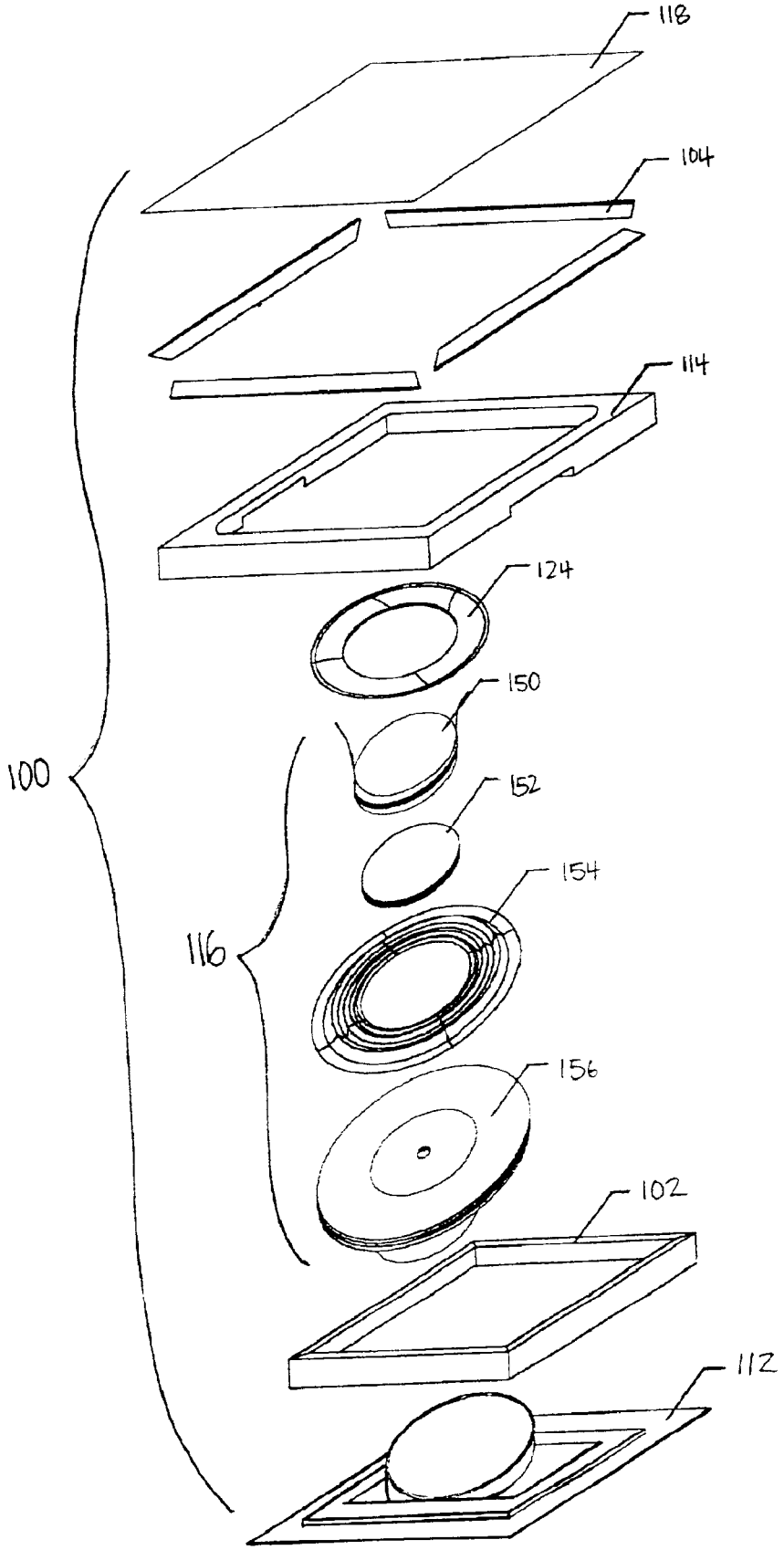
FIG. 10 is an expanded view of another embodiment of the flat panel speaker.

According to another embodiment of the present invention, an expanded view of a flat panel loudspeaker 100 is shown in FIG. 10. The flat panel loudspeaker 100 has a back plate (or screen) 112 that may also be perforated. A non-woven felt mesh could be bonded to the screen 112 to provide higher acoustic resistance, as well as Tex Tech, a sound absorbing, high isothermal viscosity material for further optimization of impulse response; these materials can also be used together on the screen 112. The loudspeaker 100 also has a driver 116, a driver plate 114 coupled with the screen 112 using foam 102, and a sound enhancer 124 coupled with the driver 116. A membrane 118 is attached to the sound enhancer 124. The membrane 118 is stretched across the frame member 114 and attached to the frame member 114 by using an adhesive (or adhesive tape) 104 in a manner further described below. A cover (e.g., a grill, not shown) is placed over but not cover the membrane to protect the membrane and for decorative purpose.

Figure 11:
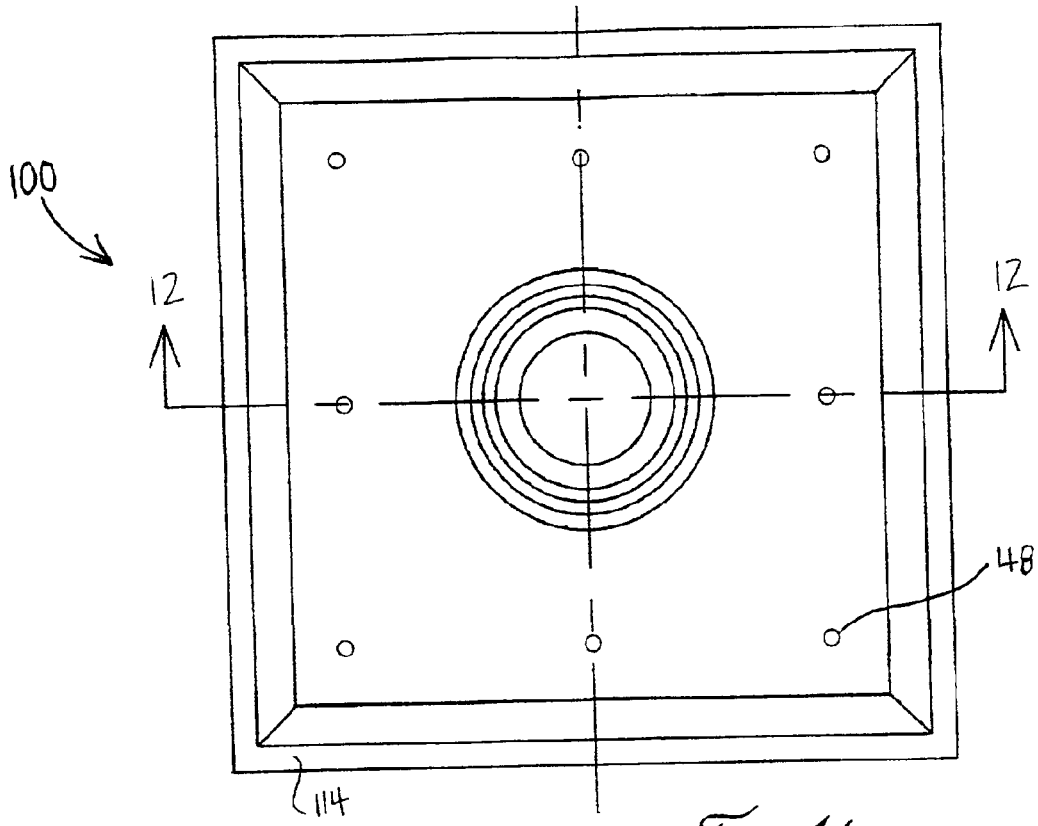
FIG. 11 is a plan view of another embodiment of the flat panel speaker.
Figure 12:
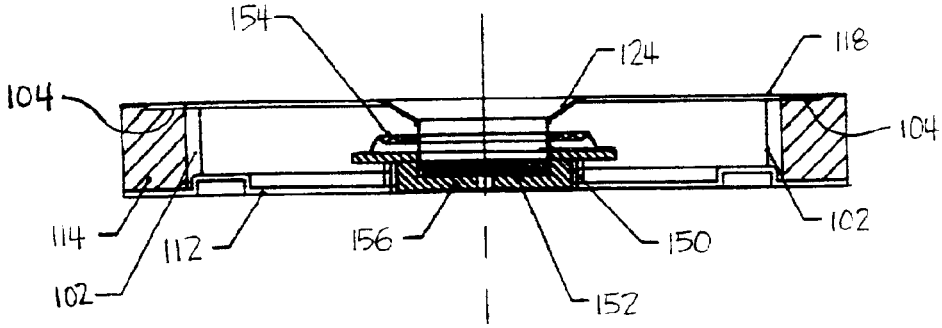
FIG. 12 is a cross-sectional view of the flat panel speaker through section 12—12 of FIG. 11.

The driver 116 shown here has a voice coil 150, a magnet 152, a damper 154, and a round yoke 156 (see also FIGS. 11 and 12). The round yoke 156 is configured to rest on a screen 112, more particularly a circular opening in the screen 112 that receives the round yoke 156. On top of the round yoke 156 is the damper 154. The magnet 152 and voice coil 150 are placed into the round yoke 156 in this particular embodiment. At the top layer of the loudspeaker 100 is the membrane 118, with the enhancer 124. The enhancer, as described previously, can be of various shapes, but here it is of the frustoconical shape.

The driver can operate at a full range and down to 200 Hz. The driver does not require crossovers, so the stereo imaging is exceptional, especially when separated at a desired distance.

Membrane and Adhesive

The membrane 118 further has edges 22 which are attached to the frame member 114. The membrane 118 is uniformly tensioned to a desired tension across the frame member 114. The membrane 118 is stretched and tensioned to lie flat on top of the frame member 114 and the enhancer 124. The tension eliminates sagging of the membrane, and also produces the desired acoustic characteristics of the speaker.

The membrane can be attached to the frame member, as well as to the enhancer, in various ways. One manner of attaching the membrane to the frame member is by utilizing an epoxy. There are numerous types of epoxy that can be used including rubber type adhesives, acrylic adhesives, silicone-type adhesives or epoxy cement. The adhesive used does not need to be limited to those listed herein. Any type of adhesive that does not contain solvents that deteriorate the speaker material and that form a reliable (and preferably permanent) bond can be used. The type of adhesive used is determined by the kind of material to be adhered.

In one embodiment, Loctite 401 is used to adhere the membrane 118 to the frame member 114 and/or to the enhancer 124. The adhesive Loctite 401 is clear in color, has a low viscosity of 110 mPa·s, a shear strength of 22 N/mm^2, a very fast fixturing speed of 2 to 30 seconds, and a temperature range between −55 to 80 degrees Celsius. The thickness of the adhesive is 0.5 mm and the width is in the range of about 2 mm.

In another embodiment, Scotch Brand VHB F-9469PC Adhesive Transfer of 5 mil (or 0.127 mm) thickness is used to adhere the membrane 118 to the frame member and/or to the enhancer. The thickness of the adhesive is in the range of about 1 mil (or 0.0254 mm). The width of the adhesive is in the range of about 3 mm. By varying the thickness and width of the adhesive, the energy absorption of the adhesive is adjusted as described in more detail below.

In a further embodiment, the rubber type adhesive is deposited on a tape surface, which has a release coating. The adhesive side of the tape is placed on an outer surface of the frame member 114. The adhesive 104 adheres to the frame member 114. The tape is then peeled from the adhesive 104 leaving only the adhesive gum. The membrane 118 is pulled over the edges of the frame member 114 to the outer surface to adhere to the adhesive 104. The adhesive 104 makes the attachment of the membrane 118 to the frame member 114 substantially permanent.

The rubber type adhesive coupling the membrane 118 to the frame member 114 also dampens the resonances, in that the rubber type adhesive softens the vibrational energy of the diaphragm and acts as an energy absorbing cushion. The frame member 118 and adhesive provide a termination for progressing waves, which if reflected would transmit vibrational energy back into membrane 118, which increases the distortion content, and causes destructive cancellations in the acoustical output response of the membrane. The soft rubber type adhesive provides a soft termination, which absorbs a portion of the vibrational energy and reduces reflections and distortion.

In another embodiment, the attached membrane 118 is uniformly tensioned in orthogonal directions. As described earlier, the membrane 118 in FIGS. 10–11 is stretched to a desired tension across the frame member 114. In one embodiment, the membrane 118 is under about 20 pounds of tension. The surface of the membrane is substantially wrinkle-free, and the membrane behaves substantially as a rigid membrane under tension and supported by the frame member 114, as if like a membrane on a drum.

For each of the embodiments, the membrane is preferably made of a thin flexible material that is durable enough to endure the vibrational forces of the driver, and yet flexible enough to vibrate in response to the driver. The membrane is generally not porous, is tensioned to a uniform force of about 5 to 30 lbs, and does not stretch even under the constant tensile load of about 5 to 30 lbs. Any thin film material could be used that is flexible enough to emanate sound waves while being strong enough to survive harsh environmental conditions. For instance, it is desired that the membrane is able to tolerate inclement temperatures such as extreme heat in a car or severe coldness in wintry conditions. It is believed that a material from the polyimide group would satisfy these requirements. In one embodiment, the material is dielectric. In another embodiment, the membrane material is a silicone based, thermosetting adhesive system. The material has high puncture resistance, is conformable, and has good high temperature performance. In another embodiment, the membrane is made of thin, flexible materials, for example, Teonex® of dupont. Teonex® is a highly oriented polymer film that would allow cleaner sound quality; the membrane made of Teonex® may be treated for adhesion promotion. In an embodiment, the Teonex membrane has a thickness of less than about 5 mil, and in a further embodiment a thickness of about 2 to 4 mil, and in a more specific embodiment a thickness of about 3 mil. In another embodiment, the membrane can be made of Kapton®, which is strong enough to endure physical constraints, as well as being resistant to chemical and environmental corrosion. Other materials, such as thin aluminum tin foil or other similar metal film, could also be used.

It is desirable to minimize the thickness and the weight of the membrane to minimize inertia due to the vibrations and approach the goal of having a "mass-less" membrane. The Kapton membrane thickness, for example, is in the range of about 0.5 mil (or 0.0127 mm) to 1.5 mil (or 0.038 mm). The preferred Kapton membrane thickness is about 1 mil (or 0.0254 mm).

The sound quality of the speaker can be significantly improved by providing small apertures strategically located on the membrane. The apertures may be 1 mm in diameter for a membrane of 12.5×12.5 cm square.

The sound quality of the speaker can also be altered by changing the contour of the membrane. For example, the membrane may have varying thicknesses and/or materials throughout the surface. However, in another embodiment, the membrane has a homogeneous surface, i.e. the same thickness and the same material throughout the membrane surface. Also, since the speaker has a flat panel, there is a larger radiating area for higher sound pressure level with little displacement, unlike convention cone type speakers.

The non-rigid planar diaphragm/membrane is capable of reproducing an extremely wide range of frequencies at all listening angles from a single speaker element. This, in turn, eliminates the acoustic blending problems associated with multi-element designs, and further increases the performance.

The membrane generally will not be able to maintain the tensile strength of about 5 to 30 pounds using the rubber type adhesive alone to attach the membrane to the frame member. Accordingly, additionally or alternatively to the adhesive, the membrane can be attached by press fit onto the frame member. For example, the membrane can be clamped into the frame member as described in more detail below with respect to FIG. 13.

Clamp

Figure 13:
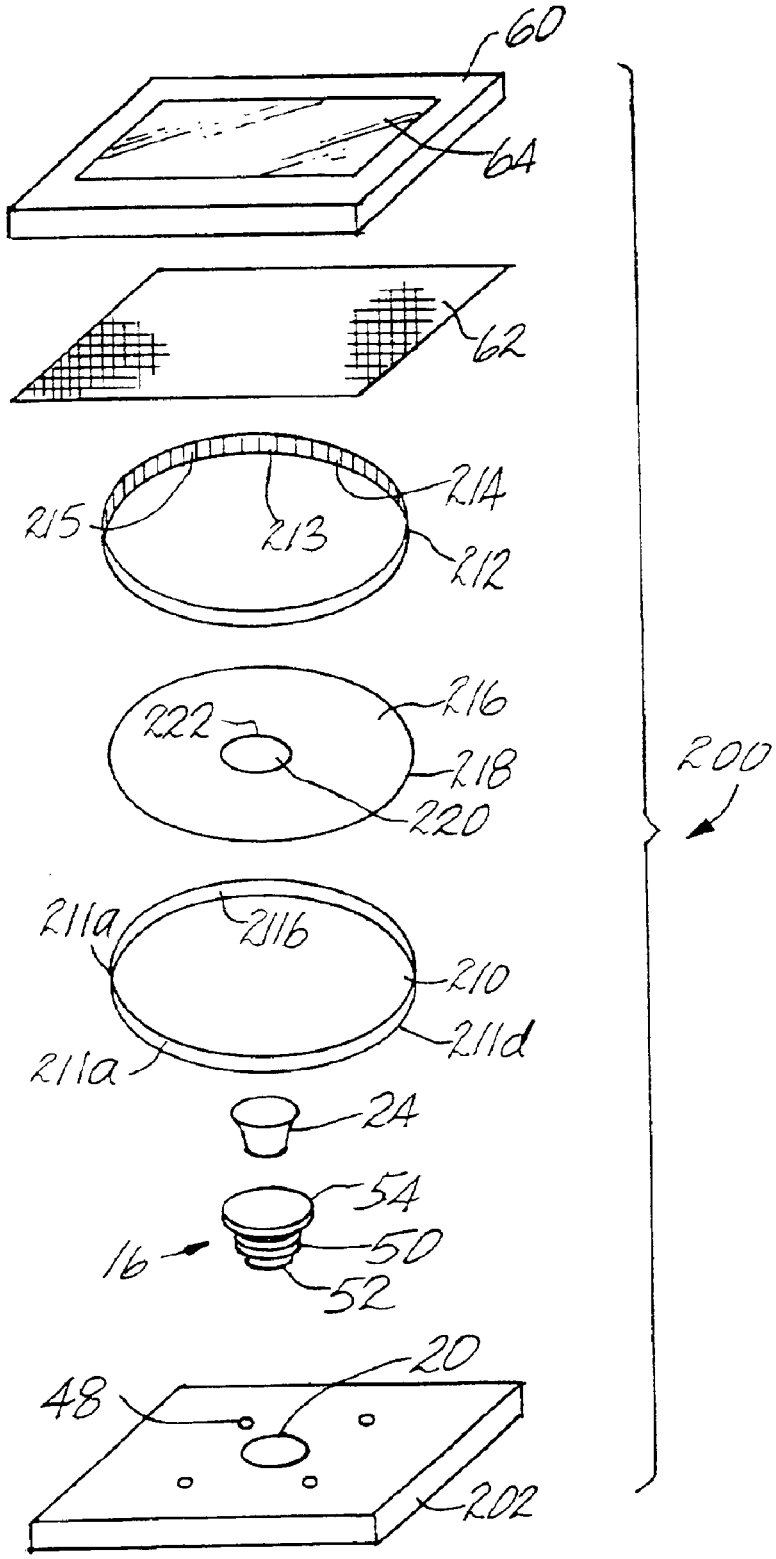
FIG. 13 is an expanded view of another embodiment of the flat panel speaker.

One embodiment with a circular-shaped clamp means, or clamp ring, is shown in FIG. 13. FIG. 13 illustrates an expanded view of a second embodiment of a flat panel loudspeaker 200. The flat panel loudspeaker 200 has a back plate 202 with the driver 16, an open frame member (or base) 210 coupled with the back plate, the sound enhancer 24 coupled with the driver 16, a membrane (or diaphragm) 216 attached to the sound enhancer and stretched across the base 210, a clamp ring 212 to press fit over the membrane and base, a cover 60 with a wire mesh 62 to protect the membrane, and cloth 64 over the wire mesh.

Figure 14:
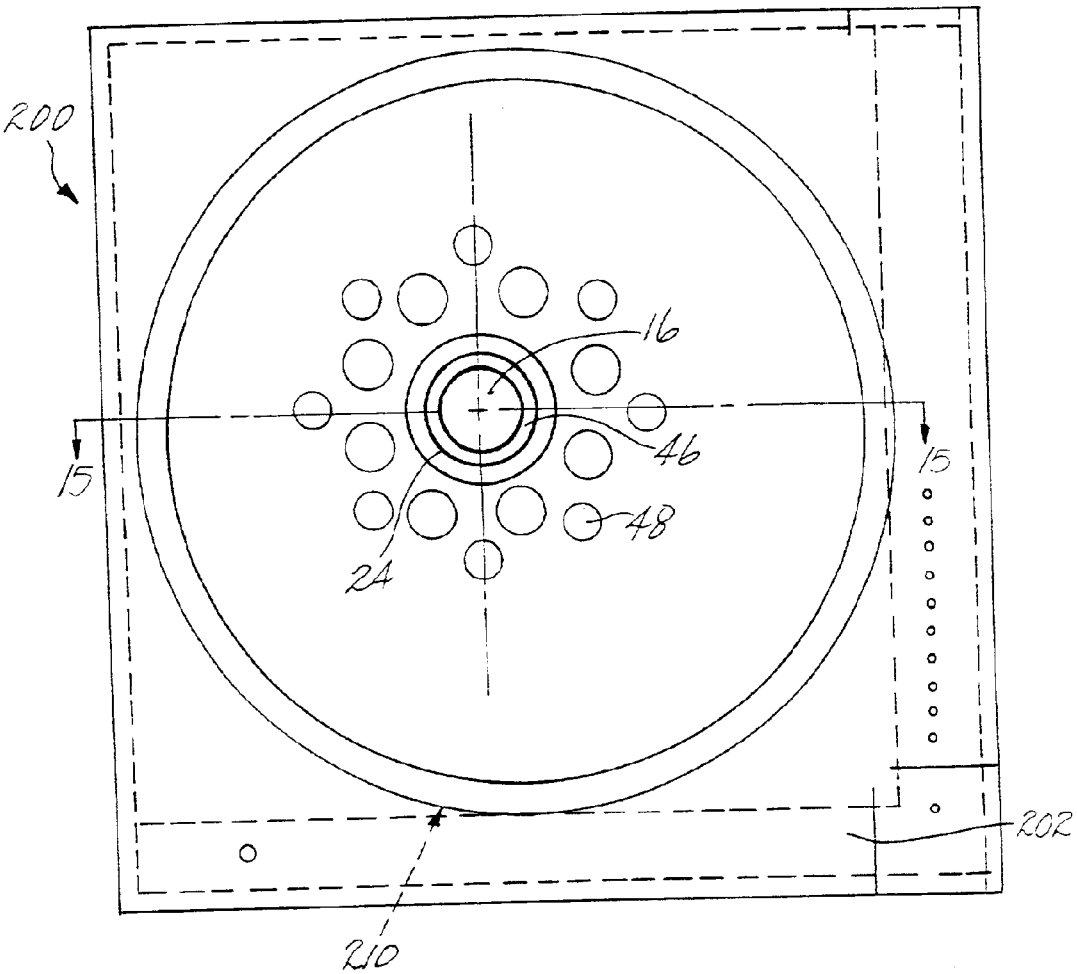
FIG. 14 is a plan view of an embodiment of the flat panel speaker, but without a diaphragm, a clamp ring or a cover.
Figure 15:
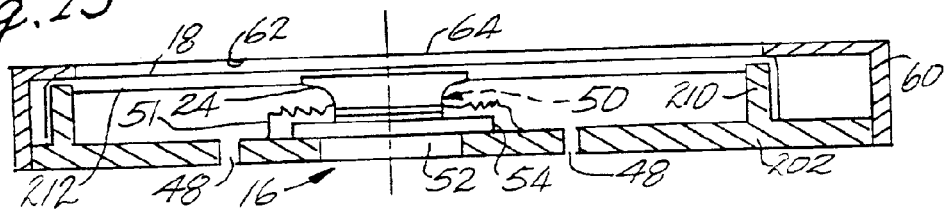
FIG. 15 is a cross-sectional view of the flat panel speaker through section 15—15 of FIG. 14 with the diaphragm, the clamp ring and the cover.

The flat panel loudspeaker 200 operates similarly to the flat panel loudspeaker 10; for example, the driver vibrates in response to an electrical signal, which in turn vibrates the sound enhancer and membrane, thereby producing sound. FIG. 14 illustrates a plan view of the speaker 200 with the back plate 202, the driver 16, the enhancer 24, and the base 210. FIG. 15 shows a cross-sectional view of the speaker 200 shown in FIG. 14 and additionally illustrating the clamp ring 212 and the cover 60.

In one embodiment, the base 210 has an open circular shape. The base has an outer surface 211*a* and an inner surface 211*b*. In between the outer surface 211*a* and the inner surface 211*b* are top and bottom surfaces, 211*c* and 211*d*, respectively. The bottom surface 211*d* of the base is attached to the back plate 202.

In one embodiment, the base 210 upon which the membrane is attached has rounded edges along the top surface 211*c* (not shown). The rounded edges render tearing of the membrane, when the membrane is stretched over them during attachment, less likely to occur.

The clamp ring 212 is circular-shaped and has an inner circular surface 213, and a bottom surface 215. A diameter of the inner circular surface 213 of the clamp ring closely corresponds to a diameter of the outer surface 211*a* of the base.

The membrane 216 has outer edges 218 which are attached to and stretched across the outer surface 211*a* and/or the top surface 211*c* of the base 210. In one embodiment, the membrane is adhered to the base 210 by the rubber type adhesive. After adhering the membrane to the base, the bottom surface 215 of the clamp ring is placed over and around the base 210. The membrane may be positioned in between the outer surface 211 a of the base and the inner surface 213 of the clamp ring. Alternatively or additionally, the membrane is positioned in between the top surface 211*c* of the base and the bottom surface 215 of the clamp ring. The surfaces of clamp ring 212 pressed together with the surfaces of the base tightly hold the membrane in a taut state.

In one embodiment, the clamp ring 212 has teeth 214 on the inside surface 213 of the clamp ring. Measured from top of the tooth to top of the neighboring tooth, the teeth are spaced apart in the range of about 2 mm to 8 mm, but preferably about 4 mm apart. Each tooth has a tooth edge at one end and a base at another end which is adjacent the inner surface of the clamp ring. The tooth base has a thickness of about 2 to 3 mm and the edge has a thickness of about 1 mm. Preferably the tooth edge is flat. In an alternative embodiment, the tooth base has a thickness of about 1 mm.

The clamp ring and teeth are preferably made of an elastic material, such as molded plastic. The inner diameter of the clamp ring at edges of the teeth 214 is slightly smaller than the diameter of the outer surface 211*a* of the base. However, the inner diameter of the clamp ring at a base of the teeth is slightly larger than the diameter of the outer surface 211*a* of the base. In this embodiment, when the clamp ring is tightly fit over the base, the teeth 214 deform slightly to capture and uniformly pull the membrane. Because the teeth deform upon application of the clamp ring, the teeth grip the membrane with a high gripping strength.

As shown in FIG. 13, the teeth 214 are tapered along the bottom surface 215 of the clamp ring. The edges of the teeth along the bottom surface are sanded down or tapered to allow assembly of the membrane. The tapered teeth allow the clamp ring to grip the membrane, and to slide the membrane down the outer surface 211*a* without tearing the membrane with the sharp edges.

The clamp ring 212 is used to achieve the desired uniform tensile strength of about 5 to 30 lbs. of force in the membrane surface. For mass production of the speaker, attaching and stretching the membrane to the frame member is generally the most difficult part of the assembly procedure. Through the gripping and holding strength of the clamp ring, the membrane can be uniformly stretched and held. Furthermore, tearing of the membrane during the stretching process is less likely to occur with the substantially even circumferential gripping of the teeth. Through the adhesive, stretching of the membrane, and press fitting the clamp over the base, the tension of the membrane can be adjusted.

Through desirable tolerances in the differences in sizes between the clamp ring and the base, the size and spacing of the teeth in the clamp ring, and the characteristics of the plastic teeth material, the membrane can be uniformly tensioned, and the membrane tensioning amount can be adjusted.

If the press fit is used in addition to using an adhesive as described above, the adhesive between the membrane and the frame member can be placed on either before or after the clamp ring is secured onto the frame member. The benefit of using the adhesive is that, again, the adhesive absorbs the vibrational energy from the membrane and substantially permanently attaches the membrane, and reduces distortion.

As shown in FIG. 13, the back plate 202 is a rectangular shape with dimensions greater than the diameter of the base 210, but is not so limited. The back plate can have any shape and size. However, in another embodiment, edges of the base do not extend from the surface of the back plate. Similar to the embodiment described with respect to FIG. 1, the back plate 202 and the base 210 provide structural support for the speaker 200 and can be made of any rigid material that will maintain the structural integrity of the speaker while in use.

Similar to the embodiment of FIG. 1, the back plate 202 in FIG. 13 has a recess 20 provided for the driver 16, and a plurality of sound breathers 48 to release the air that is trapped between the back plate 202 and the membrane 216. The recess 20 in the back plate can either be centrally located with respect to the attached base or off-center. The sound breathers may vary in size, number and location in the back plate 202.

The sound enhancer 24 of this embodiment has the same function and possible shapes as the embodiment of FIG. 1. Further, the membrane 216 has a hole 220 defined by edge 222. Edge 222 of the hole 220 is attached to the rim 46 of the enhancer 24.

Figure 16:
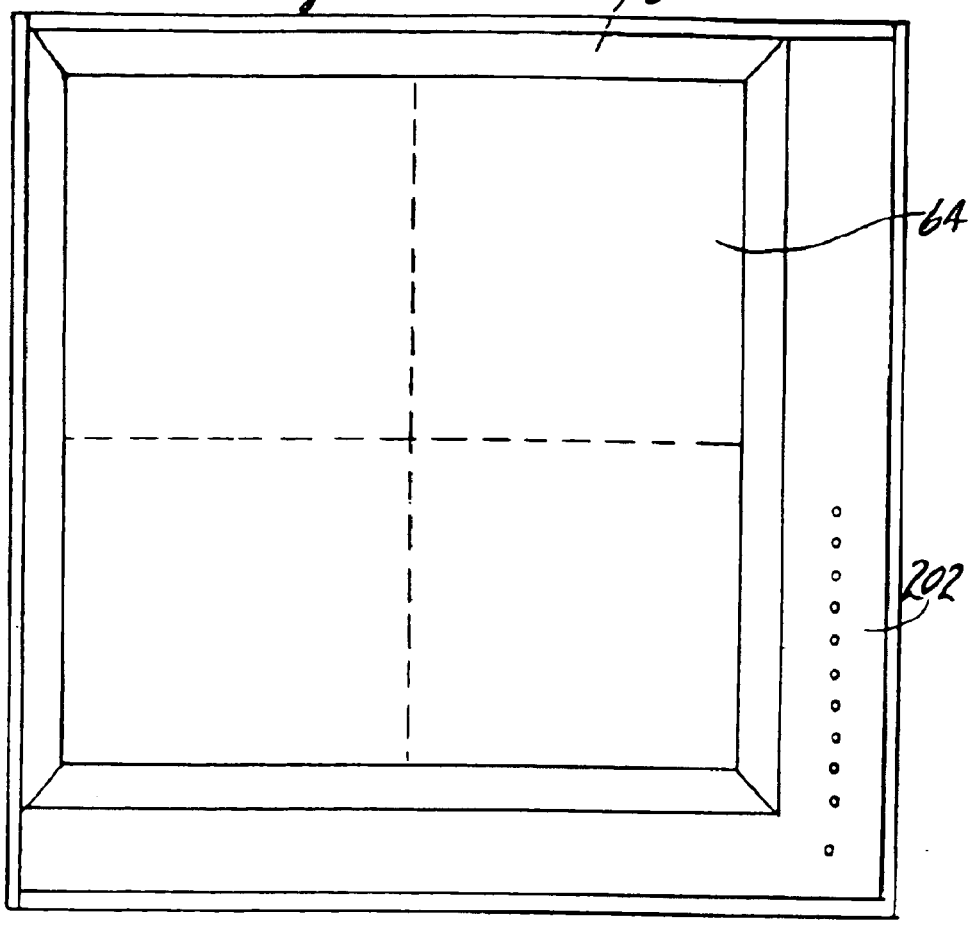
FIG. 16 is a plan view of the assembled flat panel speaker of FIG. 14 with the cover.

The cover 60 is preferably the same shape as and attached to the back plate 202. The cover and the back plate are rectangular, as shown in the embodiment of FIG. 13 and the embodiment of FIGS. 14–16. As shown in the cross-sectional view of FIG. 15 and the plan view of FIG. 16, the cover 60 is a protective and aesthetic frame that is placed over the membrane. The cover has a wire mesh 62 and a cloth 64 that is placed over the wire mesh. As shown in FIG. 15, when the cover is attached to the back plate, the wire mesh is spaced from the membrane so as not to interfere with the vibration thereof. As previously disclosed, the placement of the sound breathers 48 in the back plate may vary as shown by the different back plate embodiments of FIGS. 1, 8, 13, and 14, respectively.

Figure 17:
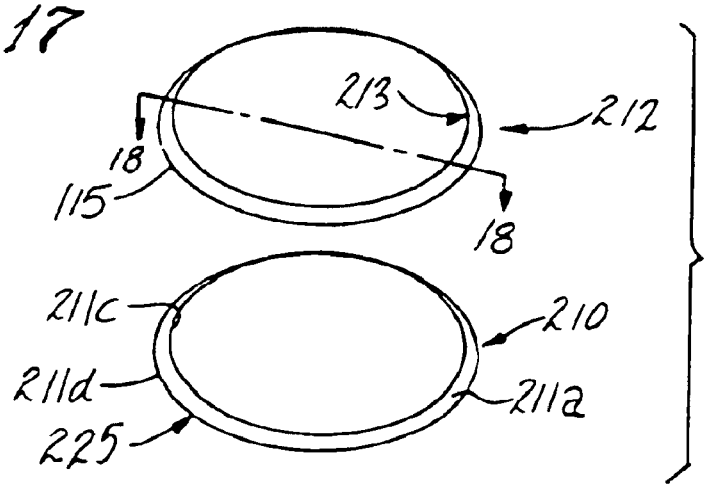
FIG. 17 is a perspective view of an alternative embodiment of the base and the clamp ring of the present invention.

Another embodiment is shown in FIG. 17, and the cross-sectional view of the clamp ring of FIG. 17 illustrated in FIG. 18. The base 210 has the bottom surface 211*d* with an outside edge 225, the top surface 211*c* with a smaller diameter than that of the bottom surface 211*d*, and the outer surface 211*a* which is defined between the top surface and the outside edge of the bottom surface and is therefore tapered. The clamp ring 212 has the inner surface 213 that corresponds to the tapered outer surface 211*a* of the frame. The tapered angle $\alpha$ is about 1 to 5 degrees. As a result of the taper, the clamp ring and the base are able to fit together in a tight manner. The clamp ring 212 has a bottom surface 226 with interior edges being rounded. When the clamp ring is placed over the base, there is less likely to be a tear in the membrane due to the rounded edges. The clamp stays on the base because there is no more than about 1 mil (0.0254 mm) of tolerance between the base and the clamp. In an embodiment, the adhesive bonds the clamp to the base substantially instantaneously. In another embodiment, the clamp ring has teeth on the tapered inner surface to keep the clamp ring from sliding off of the base.

While the invention is disclosed in conjunction with the specific embodiments thereof, it is to be evident that many alternatives, modifications, and variations will be apparent to those skilled in the art in light of the foregoing description. For example, the membrane described above can be used in microphones and telephone type receivers, as well as loudspeakers. Accordingly, it is intended to embrace all such alternatives, modifications and variations as falling within the spirit and broad scope of the appended claims.

What is claimed is:

1. A loudspeaker, comprising:

a back plate comprising a screen having apertures;

a frame coupled to the back plate;

a driver coupled to the frame, the driver being responsive to an electrical signal;

an enhancer having a neck and a mouth, the neck being coupled to the driver; the enhancer being movable in accordance with the movement of the driver; and a membrane coupled to the mouth of the enhancer, the membrane supported and maintained taut by the frame.

2. The loudspeaker in accordance with claim 1 wherein the driver is coupled to the frame by support of the back plate.

3. The loudspeaker in accordance with claim 2 wherein the back plate has a recess, wherein the driver is received in the recess in the back plate.

4. The loudspeaker in accordance with claim 3 wherein the recess is off-center with respect to the frame.

5. The loudspeaker in accordance with claim 2 wherein the back plate has a recess that receives a yoke in which a magnet and a voice coil is disposed.

6. The loudspeaker in accordance with claim 1 wherein the enhancer has a shape that is at least one of frustoconical shape, parabolic shape or bell shape.

7. The loudspeaker in accordance with claim 1 wherein the thickness of the speaker, including the frame and the back plate, is less than about 30 mm.

8. The loudspeaker in accordance with claim 1 wherein the membrane has a section spanning across a space defined by the frame, wherein the section is homogeneous in thickness and material.

9. The loudspeaker in accordance with claim 1 wherein the membrane is made of a flexible and substantially non-elastic material.

10. The loudspeaker in accordance with claim 9 wherein the membrane is uniformly tensioned to about 5 to 30 pounds.

11. The loudspeaker in accordance with claim 1, wherein the membrane is maintained taut under tension in its plane.

12. The loudspeaker in accordance with claim 1 wherein the membrane is made of at least one of:

Kapton material;

Teonex material;

a polyimide material; or a metal foil material.

13. The loudspeaker in accordance with claim 1 wherein small holes are provided on the membrane at locations near the frame.

14. The loudspeaker in accordance with claim 1 wherein the membrane has a thickness such that the membrane that is attached to the frame is flexible and durable to endure vibrational forces of the driver without appreciable stretching.

15. The loudspeaker in accordance with claim 1 wherein magnetic oil is used in the driver to dampen resonance arising from the membrane.

16. The loudspeaker in accordance with claim 1 wherein the aspect ratio of diameter of the mouth to thickness of the enhancer measured from the neck to the mouth ranges from about 3:1 to 20:1.

17. The loudspeaker in accordance with claim 16 wherein the aspect ratio of diameter of the mouth to thickness of the enhancer measured from the neck to the mouth ranges from about 8:1 to 13:1.

18. The loudspeaker in accordance with claim 1 wherein the ratio of diameter of the neck to diameter of the mouth of the enhancer ranges from about 3:5 to 3:4.

19. The loudspeaker in accordance with claim 1 wherein the enhancer is made of a fiber-reinforced paper composite.

20. The loudspeaker in accordance with claim 19 wherein about 20% to 30% of the enhancer is made of Kevlar material.

21. The loudspeaker in accordance with claim 20 wherein the membrane is adhered to at least one of the enhancer and the frame by using a rubber type adhesive that is capable of dampening resonance.

22. The loudspeaker in accordance with claim 1 further comprising a clamp, wherein the membrane is secured in between the clamp and the frame.

23. The loudspeaker in accordance with claim 22 wherein the clamp has an inner textured surface.

24. The loudspeaker in accordance with claim 22 wherein the clamp is made of an elastic material.

25. The loudspeaker in accordance with claim 1 wherein the membrane has a hole and the membrane is coupled to the enhancer such that the hole corresponds in size and location with the mouth of the enhancer.

26. A loudspeaker, comprising:

a back plate;

a frame coupled to the back plate;

a driver coupled to the frame, the driver being responsive to an electrical signal;

an enhancer having a neck and a mouth, the neck being coupled to the driver, the enhancer being movable in accordance with the movement of the driver;

a clamp; and a membrane coupled to the mouth of the enhancer and secured in between the clamp and the frame, the membrane supported and maintained taut by the frame and clamp;

wherein the frame has a tapered outer surface, wherein the clamp has an inner surface that corresponds to the tapered outer surface of the frame, whereby when the clamp is applied to the frame, the membrane is tightly secured between the frame and the clamp.

27. The loudspeaker in accordance with claim 26 wherein apertures are provided in the back plate.

* * * * *